United States Patent [19]

Pech et al.

[11] 4,034,783

[45] July 12, 1977

[54] ENDLESS-CHAIN SYSTEMS FOR FEEDING WEFT THREADS TO WEFT INSERTERS

[75] Inventors: Josef Pech; Frantisek Lapes, both of Brno, Czechoslovakia

[73] Assignee: Vyzkumny Ustav Bavlnarsky, Usti nad Orlici, Czechoslovakia

[21] Appl. No.: 606,573

[22] Filed: Aug. 21, 1975

[30] Foreign Application Priority Data

Oct. 16, 1974 Czechoslovakia ..... 7081/74

[51] Int. Cl.[2] ..... D03D 47/26

[52] U.S. Cl. ..... 139/436; 139/224 R

[58] Field of Search ..... 139/12, 13, 116, 224 R, 139/436

[56] References Cited

U.S. PATENT DOCUMENTS

| | | | |
|---|---|---|---|
| 3,732,896 | 5/1973 | Jekl et al. | 139/12 |
| 3,835,893 | 9/1974 | Galperin et al. | 139/12 |
| 3,862,648 | 1/1975 | Langr et al. | 139/12 |

*Primary Examiner*—Henry S. Jaudon

[57] ABSTRACT

A travelling-wave loom is provided with a pair of endless chains which respectively carry a plurality of weft inserters and a plurality of winding units for feeding weft threads from associated bobbins to the weft inserters. The chain carrying the winding unit is formed from a plurality of spaced rigid carrier members interconnected by standard links. Each carrier member has a groove for removably receiving the winding head, and when in position a spring-loaded pawl affixed to the carrier member releasably secures the winding head in the groove of such carrier member. Such chain also carries transversely spaced sets of rollers which are individually supported on opposite sides of an oval guide rail. One of the roller sets is spring-loaded to maintain the carrier member in firm contact with the guide surfaces.

13 Claims, 11 Drawing Figures

ENDLESS-CHAIN SYSTEMS FOR FEEDING WEFT THREADS TO WEFT INSERTERS

BACKGROUND OF THE INVENTION

The invention relates to weft insertion systems for use in travelling-wave looms, and more particularly to an endless-chain arrangement for feeding a plurality of weft threads from a plurality of bobbins to the individual weft inserters.

In known systems of this type, a first endless chain carries a plurality of spaced weft inserters around an elongated path that is curved at both ends, and a second endless chain carries a plurality of winding units around an oval path coinciding at one end with the curvature of the end path of the first chain. The winding units are individually adapted to present weft threads from an associated plurality of bobbins to the successive weft inserters during simultaneous movements of the first and second chains.

Typically, the oval path of the second chain is defined by a guiding surface of an elliptical track. A common drive member is coupled in parallel to a pair of spider elements, which engage a length of the first and second chain to ideally drive them in synchronous relation.

In practice, several disadvantages have manifested themselves with respect to the second chain, both with regard to its manner of driving by the common drive means and with regard to the mounting thereto of the associated winding heads. In particular, because of the relatively imprecise region of contact of the spider member and the successive links of the second chain, the second chain tends to move out of phase with the first chain the which it is ideally synchronized. This, in turn, leads to stresses and breakage of the weft threads. Additionally, in such arrangements the individual winding heads are affixed to the second chain via the elongated pins that interconnect the successive links of such chain. As a result, replacement and exchangeability of the winding heads is extremely difficult.

Another disadvantage of such prior art arrangements is that the adherence of the second chain to the guide surface of the associated oval track is accomplished solely by rollers disposed on the chain on one side of such track. The resulting small contact surface between the chain and the track results in instabilities during the movement of the second chain, and further contributes to stresses and breakage of the weft threads.

SUMMARY OF THE INVENTION

Such disadvantages, manifested by weft insertion systems exhibiting a second endless chain for positioning a plurality of winding heads in registration with a succession of weft inserters on a first endless chain, are overcome by the facilities of the present invention. Illustratively, the second endless chain includes a plurality of mutaully spaced, rigid carrier members each exhibiting a beveled contact surface for engagement with the associated spider of the common drive means.

Each such carrier member includes portions which extend on transversely opposite sides of the oval guide rail for supporting rollers that engage guide surfaces on both sides of such rails. The rollers disposed on one side of such guide rail are constantly urged, via spring action, against the guide surface, so that the second chain is rigidly supported against the rail to avoid the instabilities in travel exhibited by the prior art.

Additionally, each of the winding units in removably secured to one of the carrier members, rather than being permanently affixed to elongated pins that connect the successive links of the chain, as in the prior art. In one illustrative arrangement, a recess is provided in each carrier member, and a spring-loaded pawl is supported on the carrier member to releasably hold the winding head in the recess.

The mutually spaced carrier members of the second chain are interconnected by links which are connected to the adjacent end of the carrier member by elongated pins. The rollers associated with one guiding surface of the oval track are supported on the successive elongated pins.

The presence of the beveled contact surfaces on the successive rigid carrier members provides constant and unyielding engagement with the successive arms of the driving spider, resulting in a reliable and constant movement of the second chain in synchronism with the first chain.

BRIEF DESCRIPTION OF THE DRAWING

The invention is further set forth in the following detailed description taken in conjunction with the appended drawing, in which.

DETAILED DESCRIPTION

Figure 2:
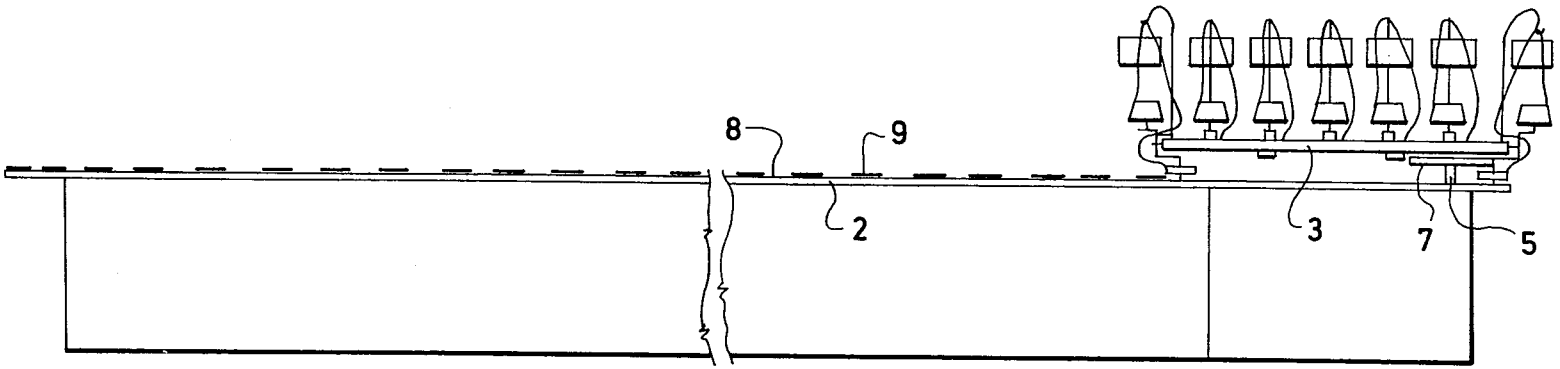
FIG. 2 is an elevation view of the arrangement of FIG. 1, with certain details removed for purposes of clarity.
Figure 1:
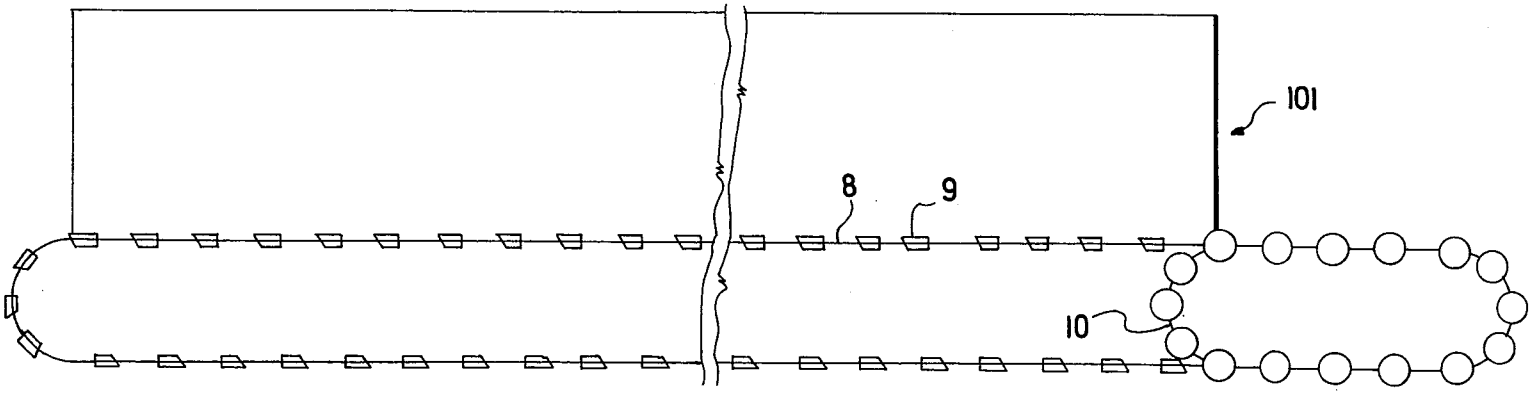
FIG. 1 is a stylized plan view of a portion of a travelling-wave loom having a first endless chain carrying successive weft inserters and a second endless chain carrying successive winding heads for presenting individual weft threads to aligned ones of the weft inserters.

Referring now to the drawings, FIGS. 1 and 2 illustrate a portion of a travelling-wave loom 101 wherein a first endless chain 8 extends in a generally longitudinal path, guided by a suitable track associated with a machine frame 2. The ends of the elongated track of the chain 8 are convexly curved. A plurality of conventional weft inserters 9, 9 are disposed in spaced relation along the chain 8 in a conventional manner.

The endless chain 8, which is driven by a suitable spider member to be described below, proceeds beneath and parallel to a second endless chain 10 which is guided along an upper rail 3 (FIG. 2) in an oval path that coincides at one end with the curvature of the path followed by the weft insertion chain 8, in a conventional manner. As described below, the chain 10 is adapted to carry a plurality of facilities for individually feeding weft threads from a corresponding plurality of bobbins to the weft inserters 9 on the underlying endless chain 8.

Figure 3:
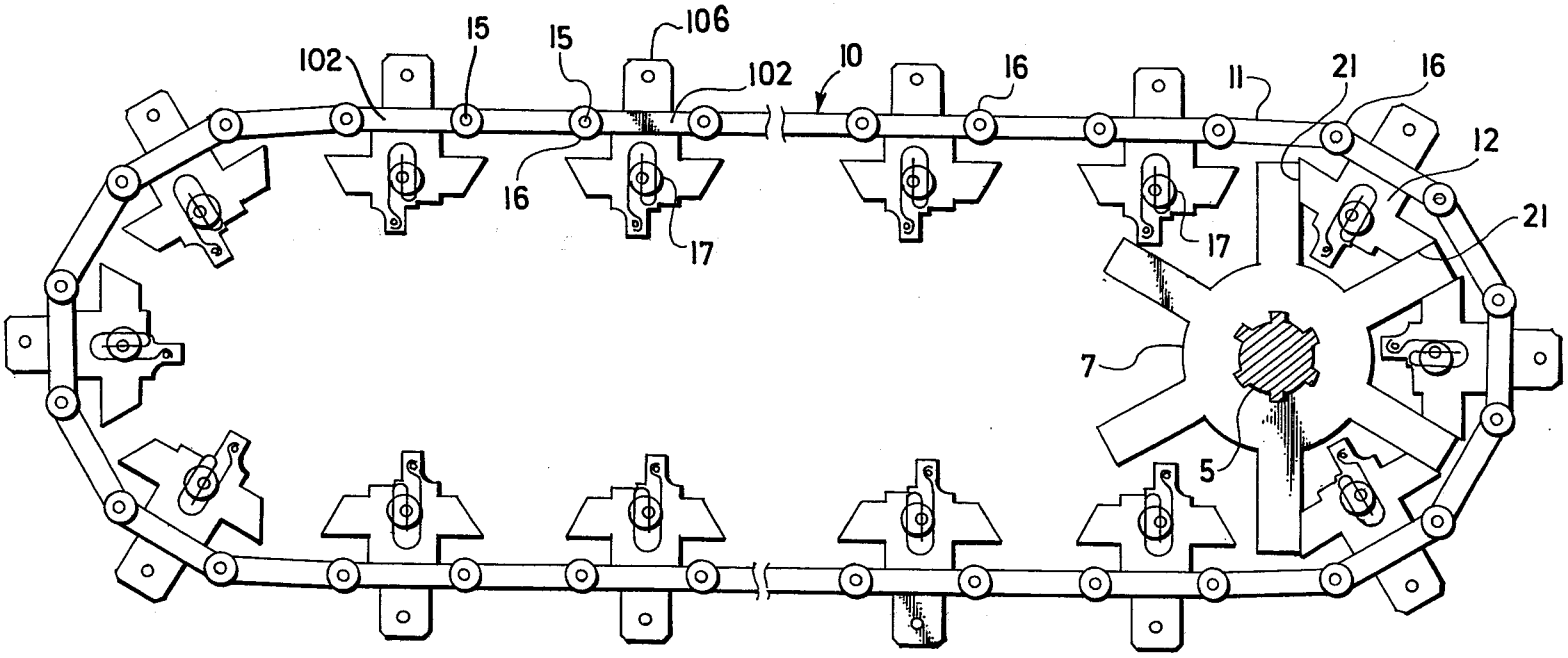
FIG. 3 is a plan view of an endless chain adapted to carry the successive winding heads in FIG. 1 and constructed in accordance with the invention.
Figure 4:
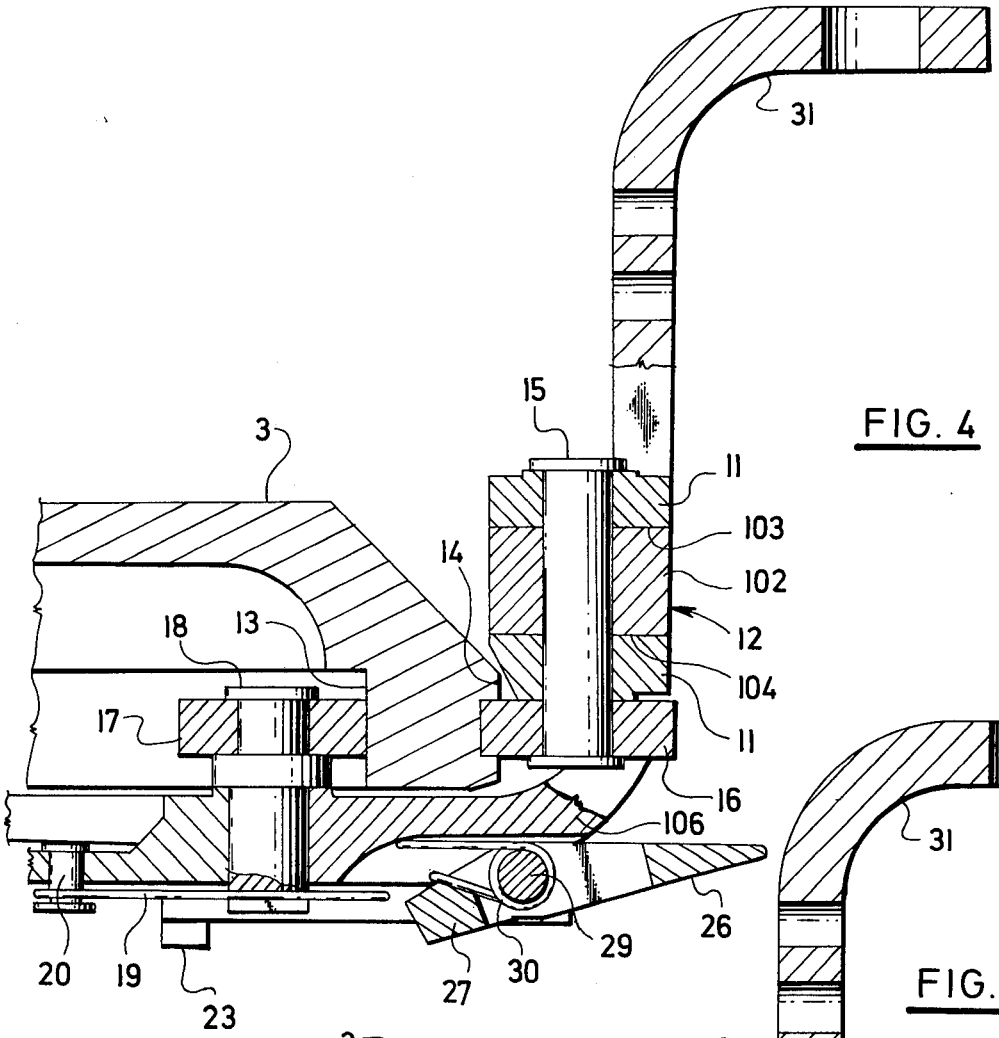
FIG. 4 is a fragmentary elevation view, in section, illustrating details of a particular carrier member and associated structures for guiding the carrier member along inner and outer guide surfaces of an oval track, together with facilities disposed on such carrier member for removably supporting a winding head which is not explicitly depicted in the figure.

In accordance with the invention and as shown best in FIG. 3, the second chain 10 includes a plurality of spaced rigid carrier members 12, which are provided with beveled contact surfaces 21 for engagement with the arms of a spider member 7 keyed to a driveshaft 5 for advancing the successive carrier members 12 along suitable guiding paths of the upper plate 3 (FIG. 4).

The successive carrier members 12 of the chain 10 are interconnected via pins 15 (FIG. 3) with a plurality of links 11; such links 11 interconnect the ends of longitudinal portions 102 of the members 12 on vertically opposite surfaces 103, 104 (FIG. 4) of the longitudinal portion 102.

Each carrier member is also provided with a portion 106 which extends transversely on opposite sides of respective inner and outer guide surfaces 13, 14 of the oval track 3. The longitudinal portion 102 and the associated links extend from the transverse portion 106 adjacent the outer guide surface 14 of the track 3.

In order to provide a secure and accurate guiding of the carrier members 12 along the track 3, each such carrier member is provided with a plurality of rollers 16 for rolling engagement with the outer guide surface 14 of the track 3. Each carrier member 12 is also provided with at least one additional roller 17 for rolling engagement with the inner guide surface 13 of the track 3.

For this purpose, a pair of the rollers 16 are mounted on each of the interconnecting pins 15 associated with opposite ends of the longitudinal member 102 in the manner shown in FIG. 3, while the opposite roller 17 is supported on a pin 18 that is affixed to the transverse portion 106 of the carrier member 12. The roller 17 is constantly urged against the associated guide surface 13 by spring-loaded means discussed below in connection with FIG. 7.

Figure 5:
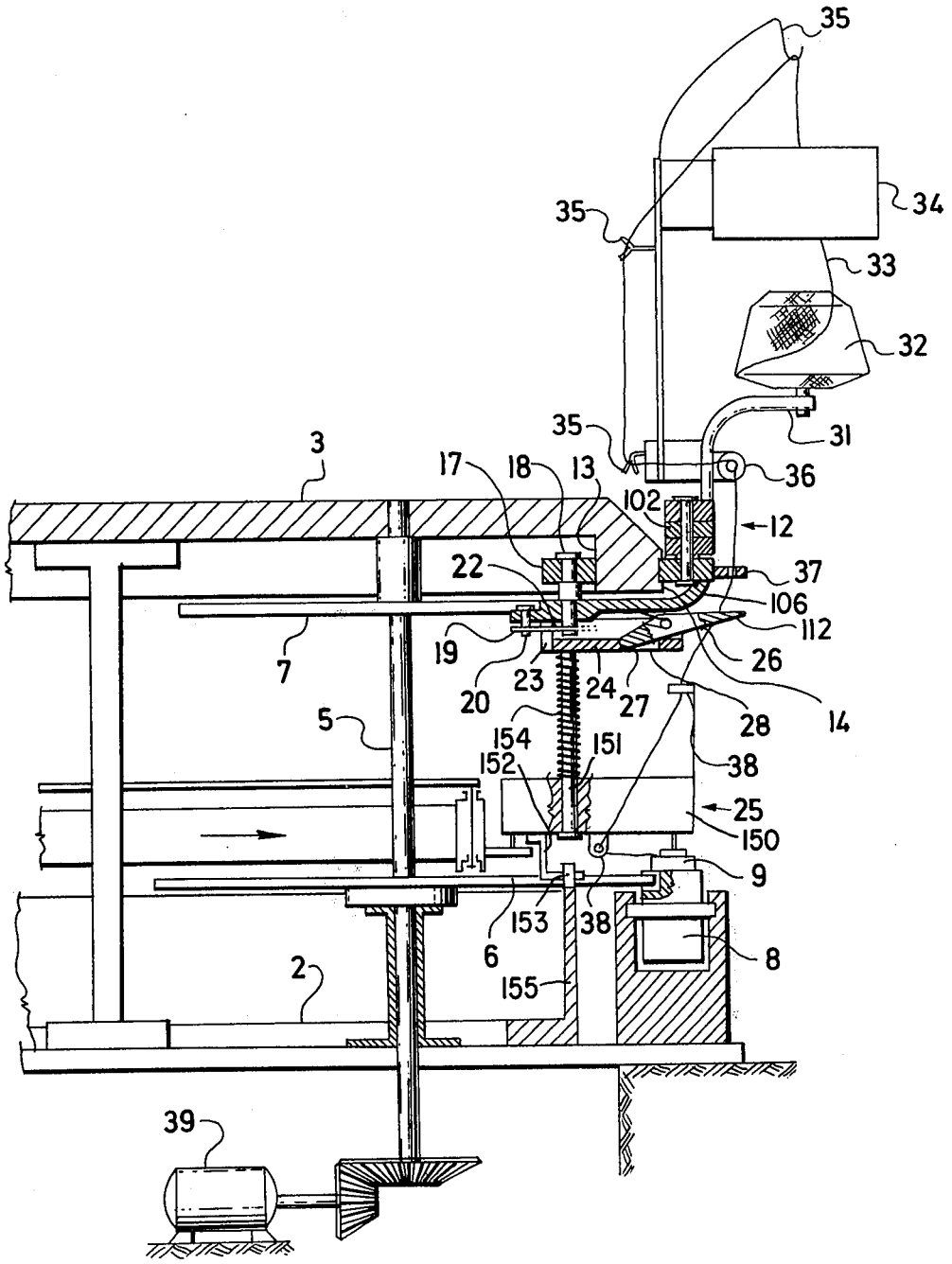
FIG. 5 is an elevation view, partly in section, illustrating facilities for synchronously driving a pair of superposed endless chains that support the weft inserters and the winding heads, respectively, the figure also illustrating bobbins and associated guiding structures associated with the winding heads.
Figure 6:
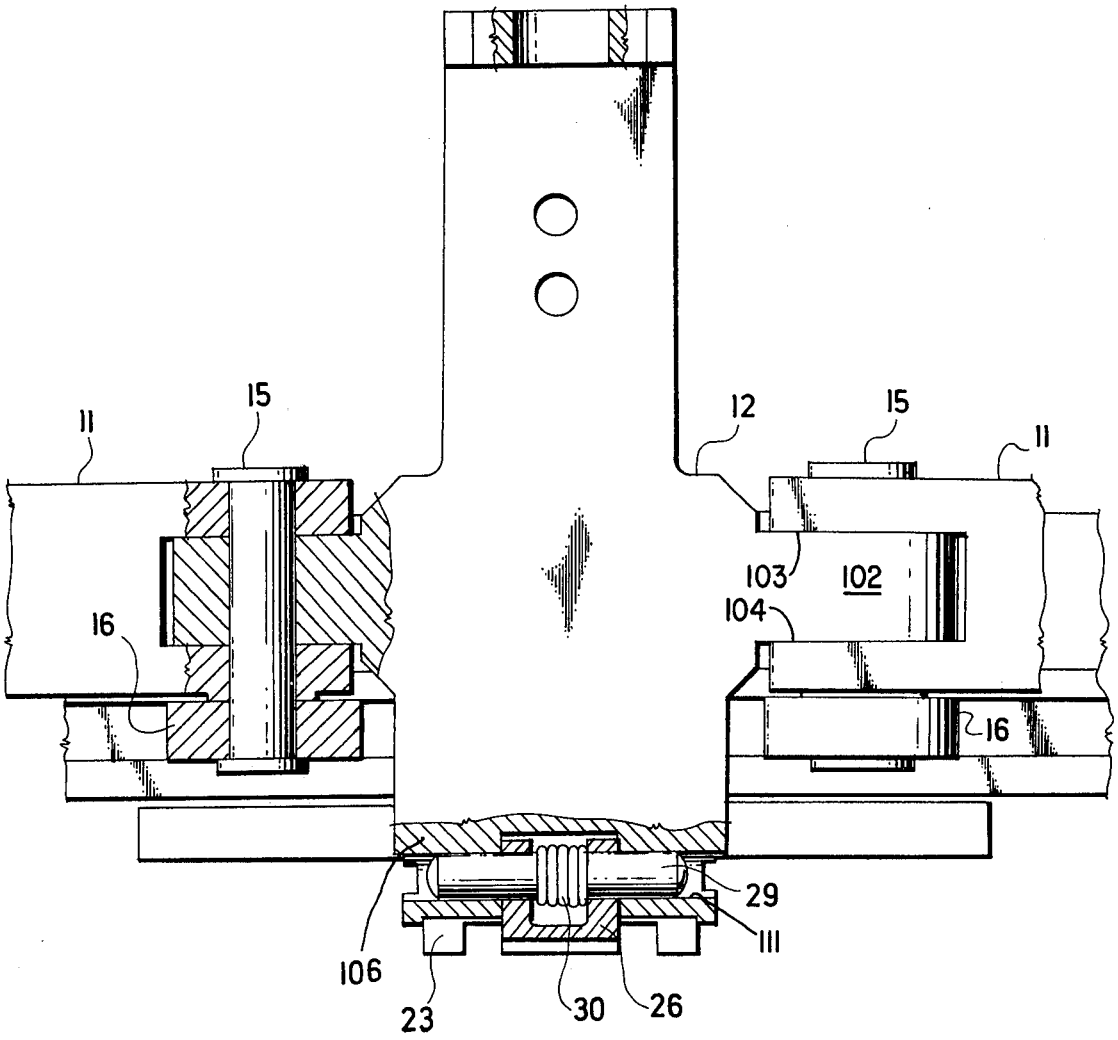
FIG. 6 is a side view of the arrangement of FIG. 4.

As shown best in FIG. 5, the spider member 7 is ganged with a similiar spider member 6 on a common rotatable shaft 5 which is geared to a common drive mechanism 39, whereby the endless chains 8 and 10 can be driven in synchronism along the paths indicated in FIGS. 1 and 2. As shown in FIG. 3, the beveled rigid surfaces 21 of the carrier members 12, cooperating with the arms of the spider member 7, assure a reliable and slip-free drive of the chain 10 relative to the chain 8 to assure the desired synchronism therebetween.

Each of the carrier members 12 of the chain 10 is adapted to removably support a winding head 25 (FIG. 5) positioned to present an associated weft thread opposite a weft inserter 9 carried on the lower chain 8. The structure of winding head 25 and the associated insertion structure of the inserter 9 are conventional in nature and are described, e.g., in U.S. Pat. No. 3,732,896, issued to Jekl et al. For example, each carrier member 12 is adapted to support a separate bobbin 32 and associated guiding structures that supply the weft thread 33 to the associated winding head 25. Such auxiliary structures, which includes a balloon limiter 34, a plurality of guides, 35 and a brake 36 mounted on a curved holder 31 which is affixed to the longitudinal portion 102 of the carrier member 12 from the brake 36, the weft thread extends from guide 37 on the carrier member 12 and a pair of guides 38 carried on a main portion 150 of the winding head 25 to the inserter 9 as shown. The winding head also includes an upper holder portion 24 which is connected to the main portion 150 via members 151 for securing the winding head 25 to the lower portion of the carrier member 12 in the manner described below. In addition, the winding head 25 includes a lifter 152 affixed to the lower end of the main portion 150, and a follower 153 supported on the lifter 152. During the movement of the winding head, the follower 153 is urged downwardly against a fixed cam 155 via the force of springs 154; the springs surround the elements 151 and extend between the bottom of the holer 24 and the top of the main portion 150.

Figure 10:
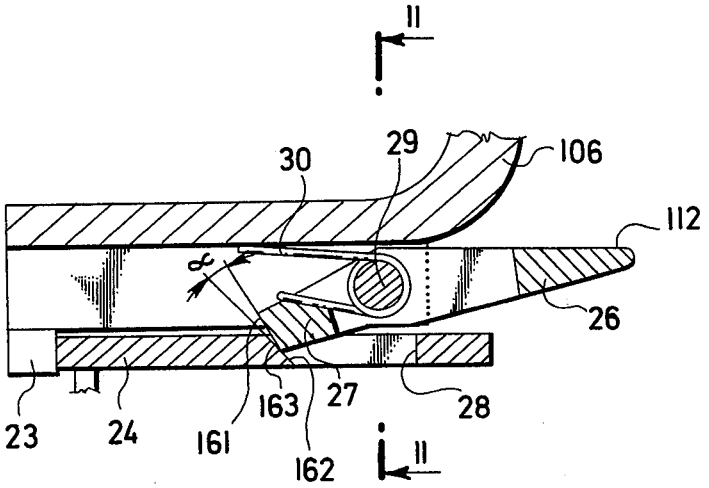
FIG. 10 is a fragmentary view illustrating the lower portion of the arrangement of FIG. 5 and indicating how the upper portion of a winding head is secured to the carrier member.
Figure 11:
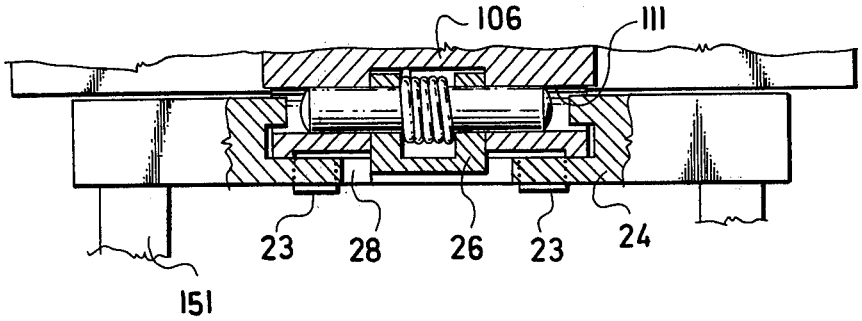
FIG. 11 is a view taken along line 11—11 of FIG. 10.

In order to secure the holder 24 to the carrier member 12, and as best shown in FIGS. 10 and 11, the holder 24 is received in a recess 28 disposed in a lower portion of the transverse member 106 of the carrier member 12. The recess 28 is bounded at one end by stop members 23, which may be integral with the transverse member 106. In this position, the holder 24 may be wedged against the adjacent stop member 23 by one end 27 (FIG. 11) of a pawl 26. The pawl 26, in turn, is pivotally mounted on a pin 29 that is secured in a central recess 111 of the transverse member 106. The pawl 26 is urged via a spring 30, into the recess 28 so that a front surface 161 of the pawl end 26 frictionally engages an oblique surface 162 of the holder 24, as shown in FIG. 10. The pawl surface 161 forms a small acute angle *a* with the oblique surface 162 in the operative position, so that an edge 163 of the pawl frictionally engages the surface 162 to maximize the wedging force on the holder 24, thereby precluding inadvertent release of the holder from the transverse member 106. In order to disengage the holder from the carrier member, a free end 112 of the pawl may be pushed down against the force of the spring 30 to disengage the edge 163 from the surface 162.

Figure 7:
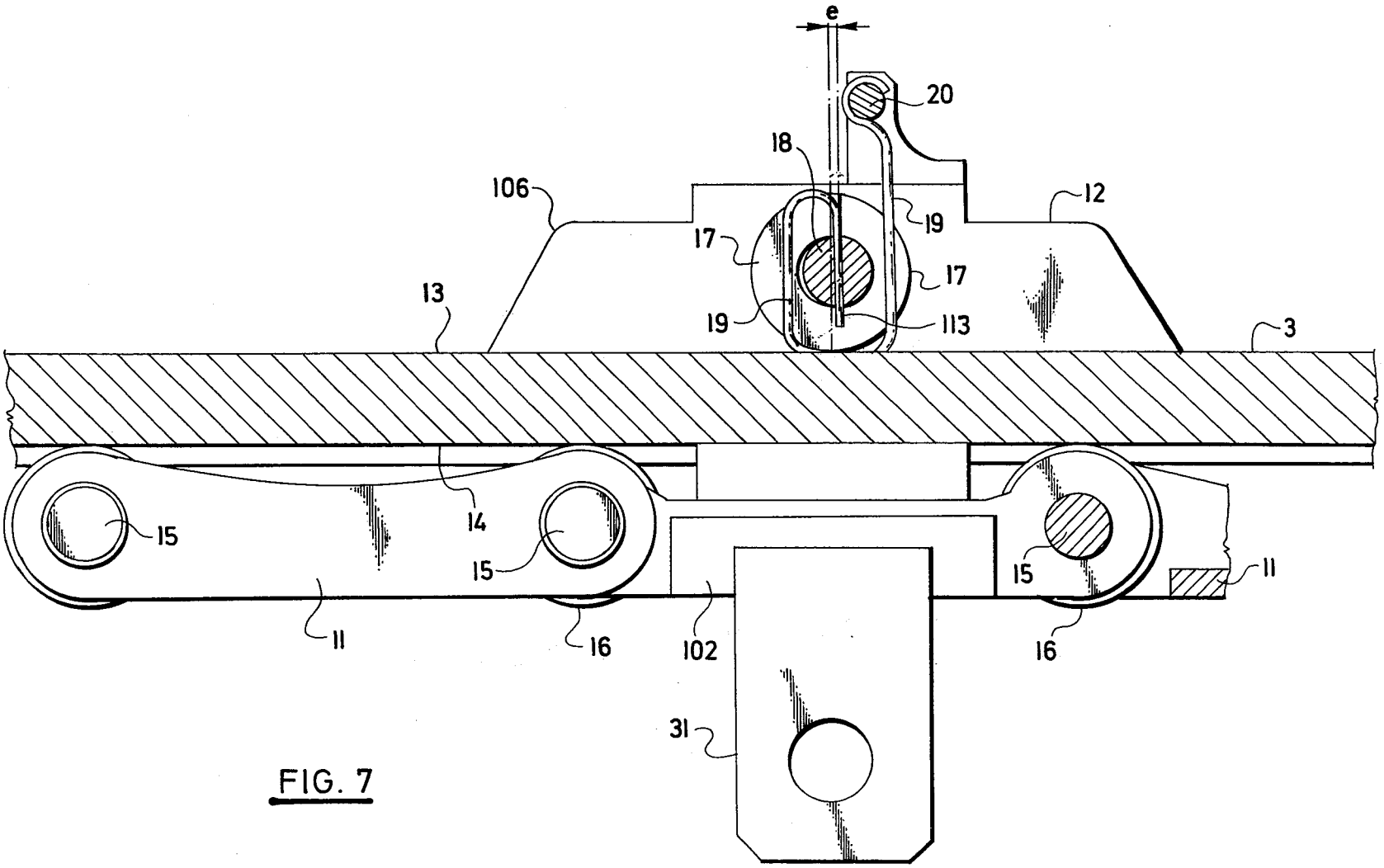
FIG. 7 is a bottom view of the arrangement of FIG. 4, with certain details removed for clarity.

Referring now to FIG. 7, one technique for urging the roller 17 against the associated guide surface 13 of the track 3 is illustrated. The pin 18 is made eccentric relative to the center of rotation of the roller 17, and a hair-pin spring 19 is associated with the roller 17, with one end 113 of such spring engaging the pin 18 and the other end being secured to an auxiliary pin 20 mounted on the transverse member 106 of the carrier 12. Because of the eccentricity of the pin 18, the spring 19 tends to rotate it in a direction to force the roller 17 against the guide surface 13, thereby simultaneously drawing the opposed rollers 16 against the outer guide surface 14 of the track 3.

Figure 8:
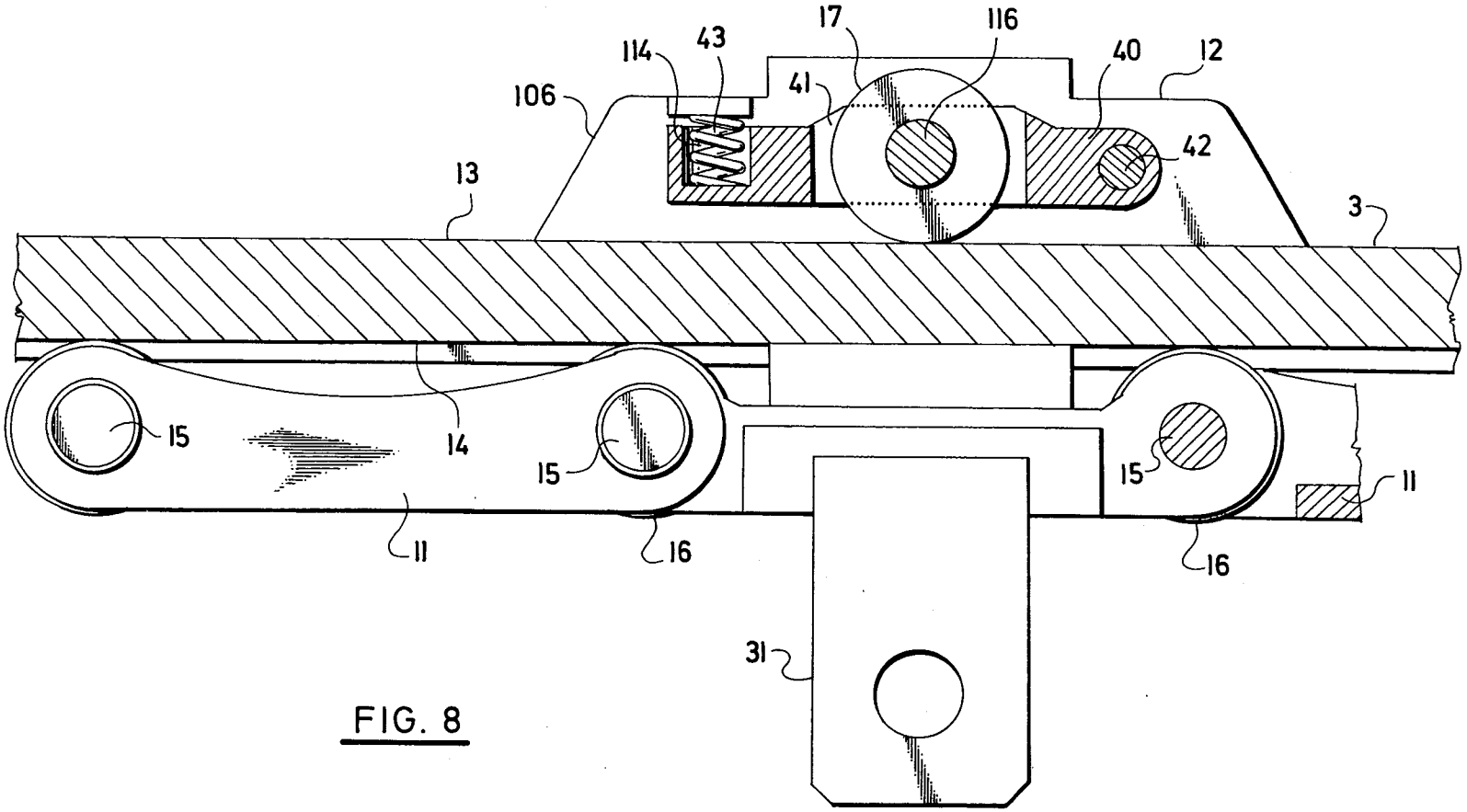
FIG. 8 is a bottom view similar to FIG. 7, illustrating an alternative technique for continually urging one set of rollers affixed to the carrier member against the adjacent guide surface of the associated track.

An alternative method of urging the roller 17 against the guide surface 13 is shown in FIG. 8. In this construction, one end of a lever 40 is pivotally mounted to a pin 42 supported by the transverse member 106, and the other end of the lever 40 is provided with a recess 114 for receiving one end of a spring 43 whose other end is suitably secured to the transverse member 106. The lever 40 has a central aperture 41 for receiving the roller 17, which is supported on a concentric pin 116. The force of the spring 43 is effective to exert a constant pressure, on the surface 13, of the roller 116.

Figure 9:
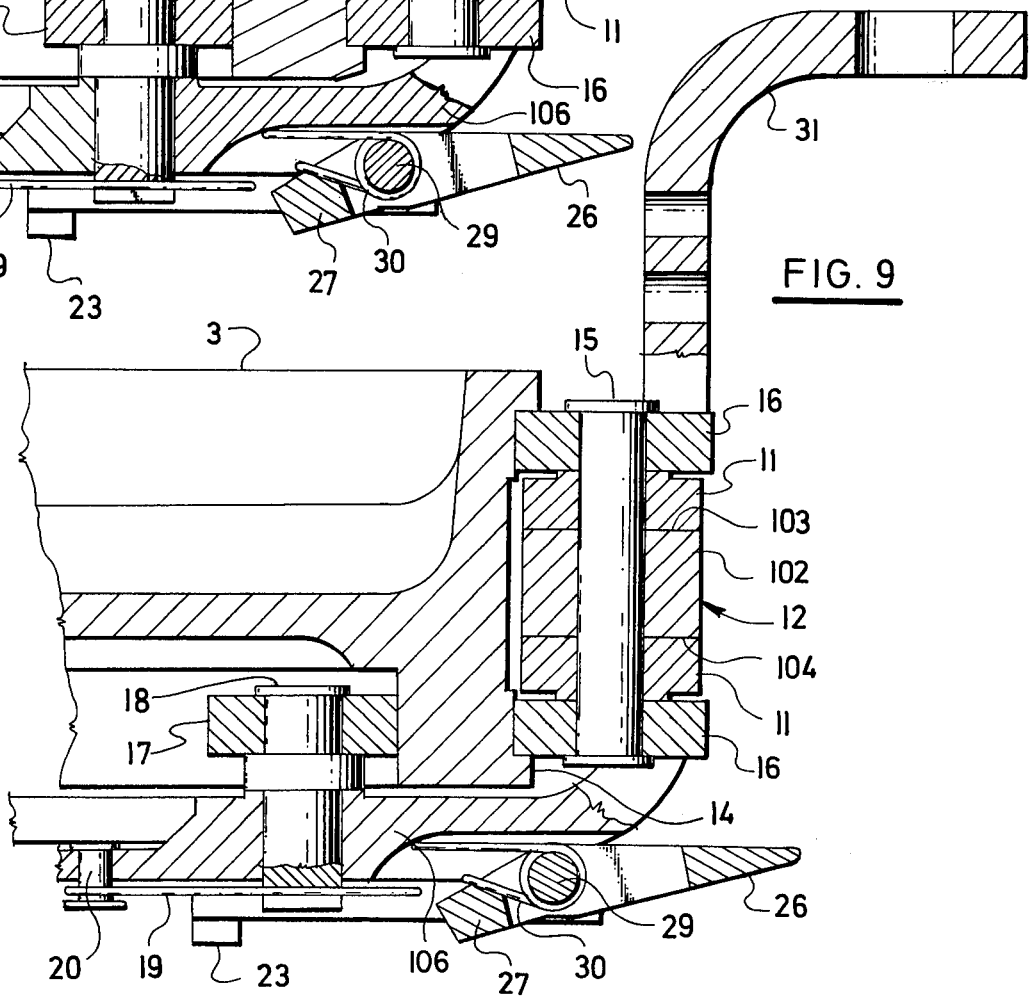
FIG. 9 is an elevation view, similar to FIG. 4, showing an alternative technique for guiding a carrier member along the adjacent guide surface of the associated track.

If desired, two superposed rows of the rollers 16 may be associated with each carrier member 12. For this purpose, as shown in FIG. 9, a pair of the rollers 16 are disposed in spaced relation to the opposed longitudinal surfaces 103, 104 of the longitudinal member 102 associated with the carrier 12. As in FIG. 4, the rollers 16 of FIG. 9 are mounted directly on the elongated pins 15 that interconnect the ends of the links 11 with the longitudinal carrier member 102. In order to accommodate the spaced superposed rollers 16, the outer guide surface 14 of the upper track 3 is elongated in the manner shown in FIG. 9. In all other respects, the arrangements of FIGS. 4 and 9 are identical.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. For use in a travelling-wave loom, a system for individually feeding a plurality of weft threads from a plurality of bobbins to weft inserters disposed in spaced relation along a first endless chain, the system comprising, in combination, a plurality of winding units individually associated with the bobbins and adapted to present the weft threads to the respective weft inserters, a second endless chain guided along an oval track, means for associating the winding units with spaced portions of the second chain, common drive means, and means associated with the first and second chains and adapted to cooperate with the common drive means for ideally effecting synchronous movement of the first and second chains, the improvement wherein the second chain comprises a plurality of rigid carrier members disposed in spaced relation, the movement effecting means comprises a contact surface disposed on each carrier member, and the associating means comprises means for individually and removably connecting the winding units to the respective carrier members.

2. A system as defind in claim 1, in which the second track has first and second transversely opposed guide surfaces, in which the carrier member is mounted to extend on transversely opposite sides of the second track, and in which the system further comprises, in combination, a first roller and at least one second roller associated with each carrier member, means for mounting the first roller to the carrier member on one transverse side of the second track for rolling engagement with the first guide surface, and means for mounting each second roller to the carrier member on the opposite transverse side of the second track for rolling engagement with the second guide surface.

3. A system as defined in claim 2, in which the second chain further comprises a plurality of first links alternating with the successive carrier members on the transverse side of the second track having the second guide surface, one end of each first link overlapping a first surface of the adjacent carrier member, and in which the system further comprises an elongated pin for interconnecting each carrier member with the adjacent first link.

4. A system as defined in claim 3, in which the second chain further comprises a plurality of second links alternating with the successive carrier members on the transverse side of the second track having the second guide surface, one end of each second link overlapping a second surface of the adjacent carrier member opposite from the first surface in alignment with the end of the associated first link, each elongated pin extending through the aligned first and second links and the carrier member.

5. A system as defined in claim 3, in which one end of each elongated pin forms a portion of the second roller mounting means, whereby the second rollers are associated with the first surfaces of the carrier members.

6. A system as defined in claim 3, in which both ends of each elongated pin form a portion of the second roller mounting means, whereby the second rollers are associated with the first and second opposite surfaces of the carrier members.

7. A system as defined in claim 2, in which each first roller is disposed intermediate an adjacent pair of the second rollers.

8. A system as defined in claim 2, further comprising means for constantly urging the first roller against the first guide surface.

9. A system as defined in claim 8, in which the urging means comprises, in combination, an eccentric pin secured to the carrier member for supporting the first roller, and a spring interconnecting the eccentric pin with the carrier member.

10. A system as defined in claim 8, in which the urging means comprises, in combination, a pin supported on the carrier member, a spring spaced from the pin and having one end supported on the carrier member, a lever having an aperture at one end through which the pin extends, and means for coupling the other end of the spring to the other end of the lever.

11. A system as defined in claim 1, in which each carrier member includes means defining a groove for removably receiving the associated winding head, and in which the winding head mounting means comprises means including a spring-loaded pawl affixed to the carrier member for releasably securing the winding head in the groove of the carrier member.

12. A system as defined in claim 1, in which the carrier member further comprises means for supporting one of the bobbins in operative relation to the winding head mounted on the same carrier member.

13. A system as defined in claim 1, in which the contact surface of each carrier member is chamfered.

* * * * *